US011566498B2

(12) United States Patent
Ferguson et al.

(10) Patent No.: US 11,566,498 B2
(45) Date of Patent: Jan. 31, 2023

(54) MULTI-ZONE PERFORATE AND TREAT SYSTEM AND METHOD

(71) Applicant: THRU TUBING SOLUTIONS, INC., Oklahoma City, OK (US)

(72) Inventors: Andrew M. Ferguson, Moore, OK (US); Brock W. Watson, Sadler, TX (US); Roger L. Schultz, Newcastle, OK (US)

(73) Assignee: Thru Tubing Solutions, Inc., Newcastle, OK (US)

( * ) Notice: Subject to any disclaimer, the term of this patent is extended or adjusted under 35 U.S.C. 154(b) by 125 days.

(21) Appl. No.: 16/755,206

(22) PCT Filed: Nov. 15, 2018

(86) PCT No.: PCT/US2018/061169

§ 371 (c)(1),
(2) Date: Apr. 10, 2020

(87) PCT Pub. No.: WO2019/099600

PCT Pub. Date: May 23, 2019

(65) Prior Publication Data

US 2021/0017839 A1 Jan. 21, 2021

Related U.S. Application Data

(60) Provisional application No. 62/588,150, filed on Nov. 17, 2017.

(51) Int. Cl.
*E21B 43/114* (2006.01)
*E21B 34/14* (2006.01)
(Continued)

(52) U.S. Cl.
CPC ..... *E21B 43/114* (2013.01); *E21B 34/142* (2020.05); *E21B 43/119* (2013.01); *E21B 43/26* (2013.01); *E21B 2200/04* (2020.05)

(58) Field of Classification Search
CPC .. E21B 43/114; E21B 34/142; E21B 2200/04; E21B 43/119; E21B 43/26
See application file for complete search history.

(56) References Cited

U.S. PATENT DOCUMENTS 9,309,746 B1 * 4/2016 Watson ..... E21B 34/10
2005/0211439 A1 9/2005 Willet et al.
(Continued)

FOREIGN PATENT DOCUMENTS

WO 2017096078 A1 6/2017
WO 2019099600 A1 5/2019

OTHER PUBLICATIONS

International Search Report with Written Opinion dated Mar. 4, 2019 for PCT Patent Application No. PCT/US2018/061169, 13 pages.

(Continued)

*Primary Examiner* — Christopher J Sebesta
(74) *Attorney, Agent, or Firm* — Smith IP Services, P.C.

(57) ABSTRACT

A downhole well tool assembly can include a perforator and a selectively openable and closable perforation plug discharge port. A method of perforating and treating multiple formation zones of a well in a single trip of a downhole well tool assembly into the well can include positioning the downhole well tool assembly at a zone, closing a perforation plug discharge port of the downhole well tool assembly, perforating the zone, treating the zone, opening the perforation plug discharge port, deploying perforation plugs into the well via the perforation plug discharge port, plugging perforations in the zone with the perforation plugs, positioning the downhole well tool assembly at a subsequent zone, closing the perforation plug discharge port, perforating the subsequent zone, and treating the subsequent zone.

10 Claims, 15 Drawing Sheets

(51) Int. Cl.
*E21B 43/119* (2006.01)
*E21B 43/26* (2006.01)

(56) References Cited

U.S. PATENT DOCUMENTS

| | | | | |
|---|---|---|---|---|
| 2006/0196667 | A1* | 9/2006 | Alba | E21B 33/128 166/308.1 |
| 2008/0047707 | A1* | 2/2008 | Boney | E21B 43/114 166/270 |
| 2013/0213655 | A1* | 8/2013 | Martinez | E21B 43/114 166/298 |
| 2014/0048333 | A1* | 2/2014 | Fears | E21B 43/114 175/57 |
| 2016/0145989 | A1* | 5/2016 | Ferguson | E21B 33/138 166/281 |
| 2016/0348467 | A1 | 12/2016 | Watson et al. | |
| 2017/0292343 | A1 | 10/2017 | Watson et al. | |
| 2021/0017839 | A1 | 1/2021 | Ferguson et al. | |

OTHER PUBLICATIONS

GCC Examination Report dated May 12, 2020 for GCC Patent Application No. 2018-36474, 4 pages.
Canadian Examination Report dated Jun. 7, 2021 for Canadian Patent Application No. 3,078,389, 5 pages.
Canadian Examination Report dated Jan. 14, 2022 for CA Patent Application No. 3,078,389, 5 pages.
Argentina Office Action dated Nov. 18, 2021 for AR Patent Application No. 20180103370, 5 pages.
English Translation of Argentina Office Action dated Nov. 18, 2021 for AR Patent Application No. 20180103370, 5 pages.
Argentina Office Action dated May 26, 2022 for AR Patent Application No. 20180103370, 4 pages.
English Translation for Argentina Office Action dated May 26, 2022 for AR Patent Application No. 20180103370, 4 pages.
Canadian Examination Report dated Sep. 13, 2022 for CA Patent Application No. 3,078,389, 5 pages.

* cited by examiner

MULTI-ZONE PERFORATE AND TREAT SYSTEM AND METHOD

CROSS-REFERENCE TO RELATED APPLICATIONS

This application is a national stage under 35 USC 371 of International Application No. PCT/US18/61169 filed on 15 Nov. 2018, which claims the benefit of the filing date of U.S. Provisional Application No. 62/588,150 filed on 17 Nov. 2017. The entire disclosures of these prior applications are incorporated herein by this reference.

TECHNICAL FIELD

This disclosure relates generally to equipment utilized and operations performed in conjunction with a subterranean well and, in some examples described below, more particularly provides for perforating and treating multiple formation zones in a single trip of a tool assembly into a wellbore.

BACKGROUND

Production of hydrocarbons from a well can be enhanced by various forms of treatment, such as, fracturing, acidizing, injection of permeability enhancers, conformance agents, etc. In cases where it is desired to perforate and treat multiple formation zones of a well, the time and costs required to perform these operations can be reduced by perforating and treating the multiple zones in a single trip.

Therefore, it will be readily appreciated that improvements are continually needed in the art of multiple zone perforating and treating operations. Such improvements may be useful for completions of hydrocarbon production wells, and may also be useful for injection wells, disposal wells, geothermal wells, or other types of wells.

DETAILED DESCRIPTION

Figure 1A:
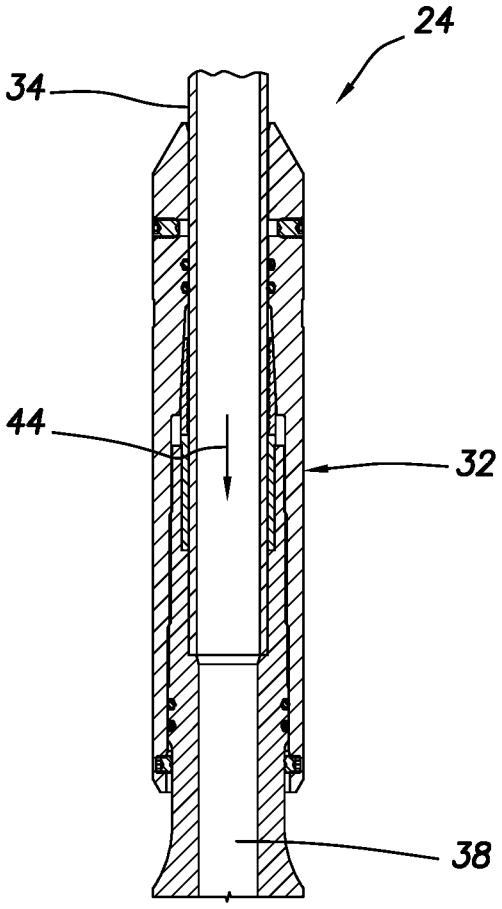
FIGS. 1A-C are representative partially cross-sectional views of successive axial sections of an example of a well tool assembly and associated method which can embody principles of this disclosure.

Described below and representatively illustrated in the drawings are examples of a multi-zone perforate and treat system and associated method which can embody principles of this disclosure. However, it should be clearly understood that the system and method are merely specific examples of applications of the principles of this disclosure in practice, and a wide variety of other examples are possible. Therefore, the scope of this disclosure is not limited at all to the details of the system and method examples as described herein and/or depicted in the drawings.

In one example, this disclosure describes a method and apparatus for fracturing (or otherwise treating or stimulating) a new well using an abrasive jet perforator and perforation plugs. In other examples, other types of perforators (such as, explosive shaped charge guns, mechanical or chemical perforators, etc.) may be used.

An example of the new system and method disclosed herein uses a coiled tubing abrasive perforator and perforation plugs. The system and method can in some examples reduce the time required to complete each perforate and treat stage to approximately 15 minutes or less.

Some advantages of the new system and method can include:

- Reduced unproductive time between stages.
- Less water required.
- No drill out of plugs required after treatment.
- Reduced sanding off of perforations.
- Reduction or elimination of the need for a pad.
- Less horsepower is required to fracture or otherwise treat a formation.

This example uses a coiled tubing abrasive perforator and perforation plugs to respectively create and close perforations during a well fracturing operation. The fracturing or other treating fluids are pumped down an annulus between the coiled tubing and the casing.

After fracturing or other treating, the perforations are closed by pumping perforation plugs down the tubing and out a window or discharge port. Since the perforations are isolated by the perforation plugs, "frac" plugs typically set between stages are not required.

Figure 1B:
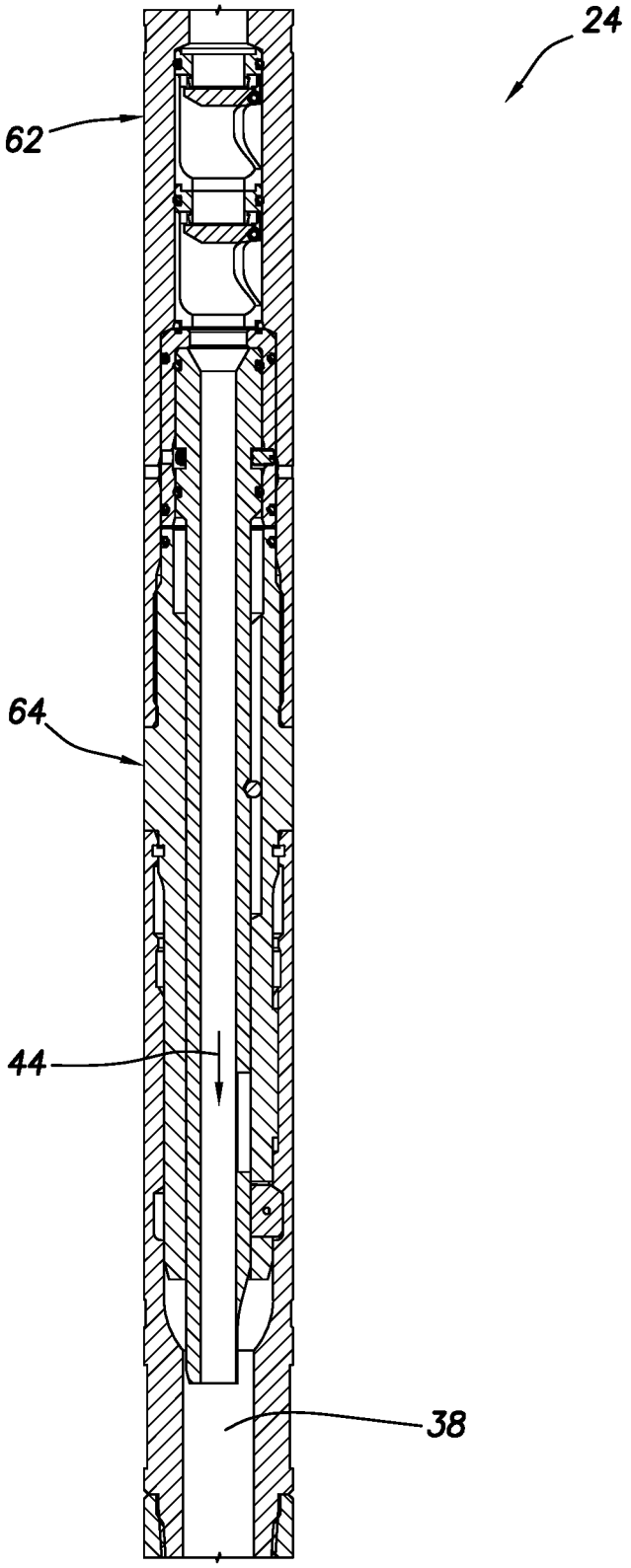
Figure 1C:
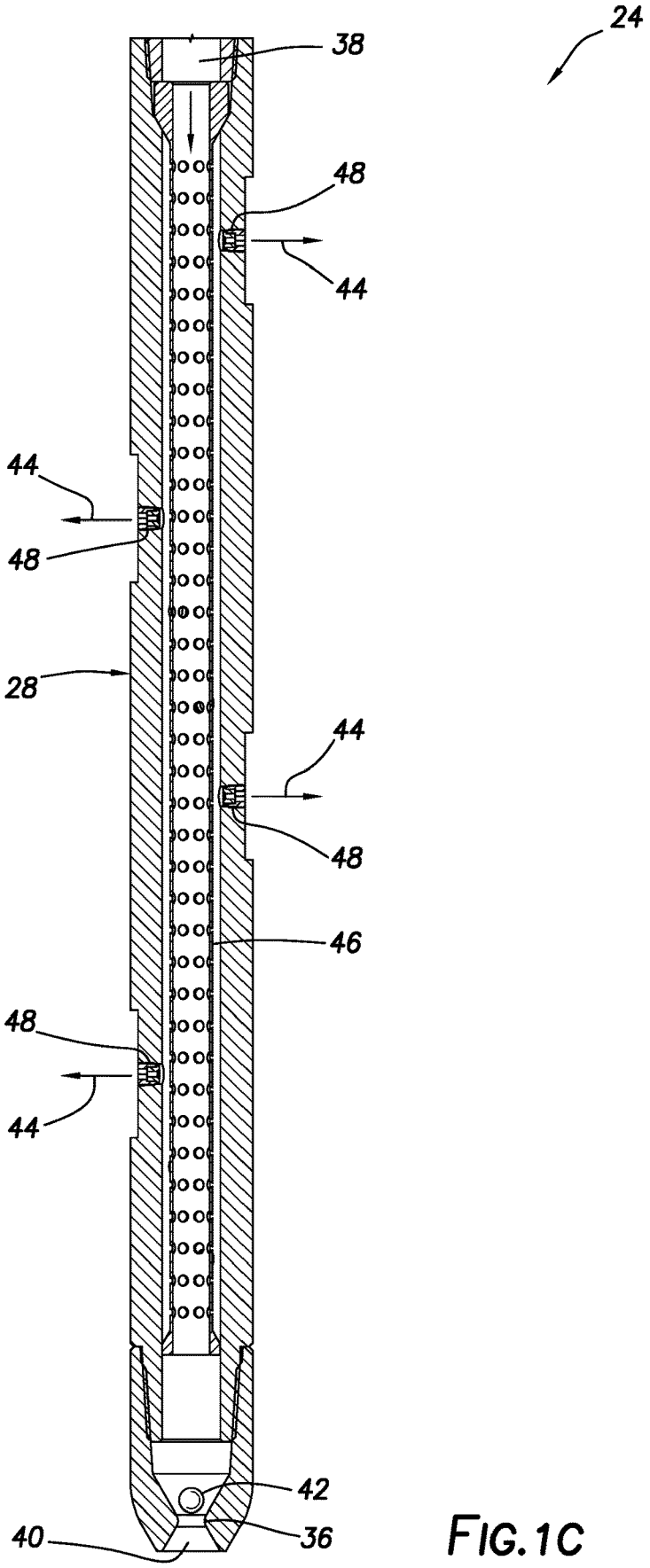

An example well tool assembly 24 is representatively illustrated in FIGS. 1A-C. In a fracturing operation example method, an abrasive perforator 28 cuts perforations through casing at a certain formation zone. Next, treatment fluids are pumped through the perforations, and into the formation zone, thereby fracturing the zone.

Note that, in a treatment stage, one or more formation zones may be perforated and treated. For simplicity and clarity, the description herein will assume that a single formation zone is perforated and treated in each stage, but it should be clearly understood that in other examples multiple zones may be perforated and treated in a single stage. In addition, in the specific examples described herein, the treatment comprises fracturing, but in other examples the treatment could also, or alternatively, comprise acidizing or another treatment technique.

At or near an end of the fracturing, new perforations can be cut with the abrasive perforator 28. After the perforations are cut, perforation plugs are pumped down the coiled tubing (or other type of tubular string 34) and out a discharge port 40 of the perforator 28 to plug up the previous perforations. The discharge port 40 is opened by a manipulation of flow rate, pressure, or by the effect of a ball, dart or other plugging device 42 on the discharge port.

FIGS. 1A-C shows an example well tool assembly 24 that can be used to perforate and to deploy perforation plugs. A restriction 36 at a lower end of the perforator 28 can be blocked by a ball or other plugging device 42, which allows the perforator to abrasively perforate, for example, at around 2500 to 3000 psi (~13.8 to 20.7 MPa) differential pressure applied from an interior longitudinal flow passage 38 to an exterior of the well tool assembly 24.

After perforating, the pressure differential can increased to a predetermined higher pressure differential by increasing a flow rate of fluid 44 through the flow passage 38. This increased differential pressure across the plugging device 42 forces the plugging device through the restriction 36, leaving the discharge port 40 open for deployment of perforation plugs.

A tubular screen 46 is used in the FIGS. 1A-C example to prevent the perforation plugs from blocking or sticking to nozzles 48 of the perforator 28. Another plugging device 42 can be pumped down to the restriction 36 (e.g., from surface via the tubular string 34 and flow passage 38) when it is desired to reactivate the perforator 28. The restriction 36 can be a rigid reduced inner diameter that permits a plugging device 42 to extrude through at a predetermined pressure differential from the flow passage 38 to the exterior of the well tool assembly 24.

Figure 1D:
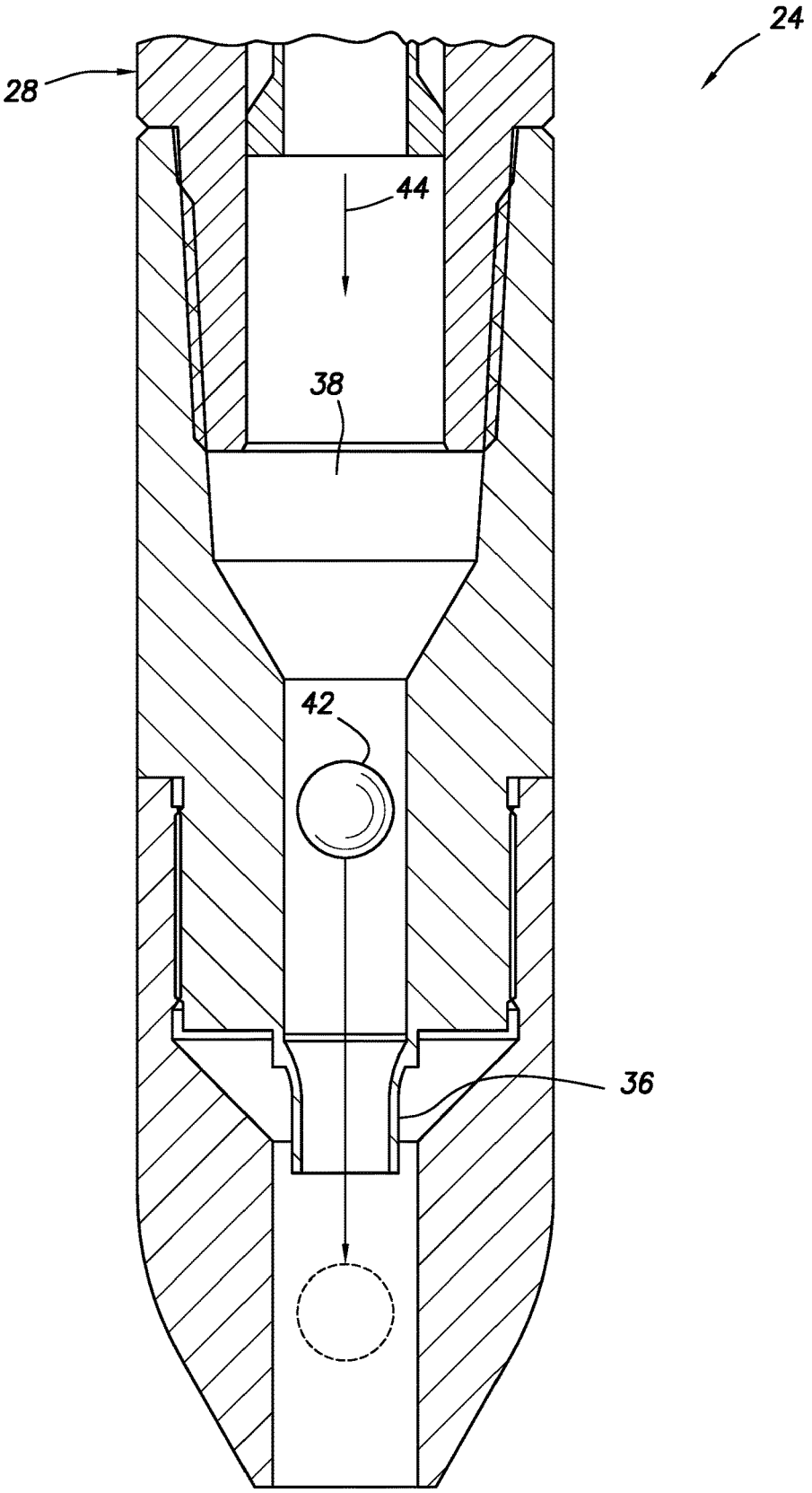
FIG. 1D is a representative cross-sectional view of an alternate discharge port section that may be used with the well tool assembly and method of FIGS. 1A-C.
Figure 2A:
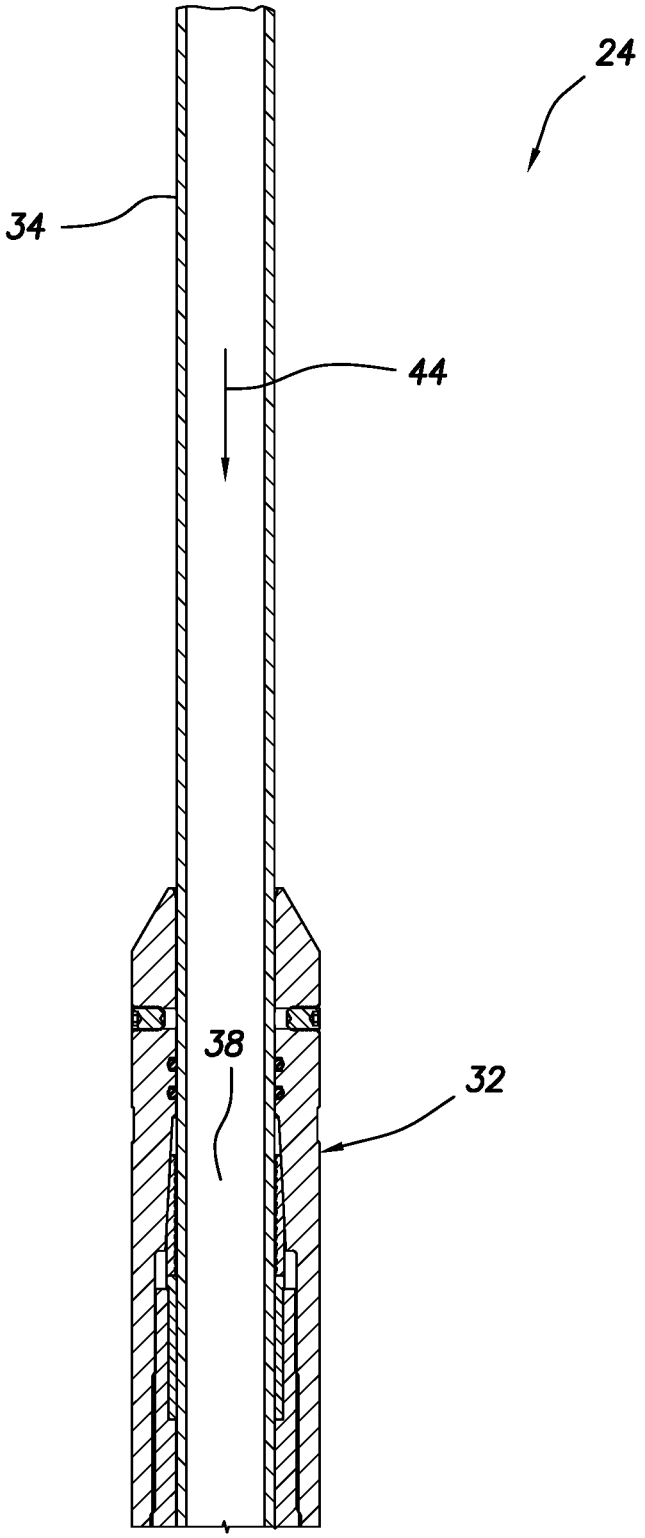
FIGS. 2A-G are representative partially cross-sectional views of successive axial sections of another example of the well tool assembly and associated method which can embody the principles of this disclosure.
Figure 2B:
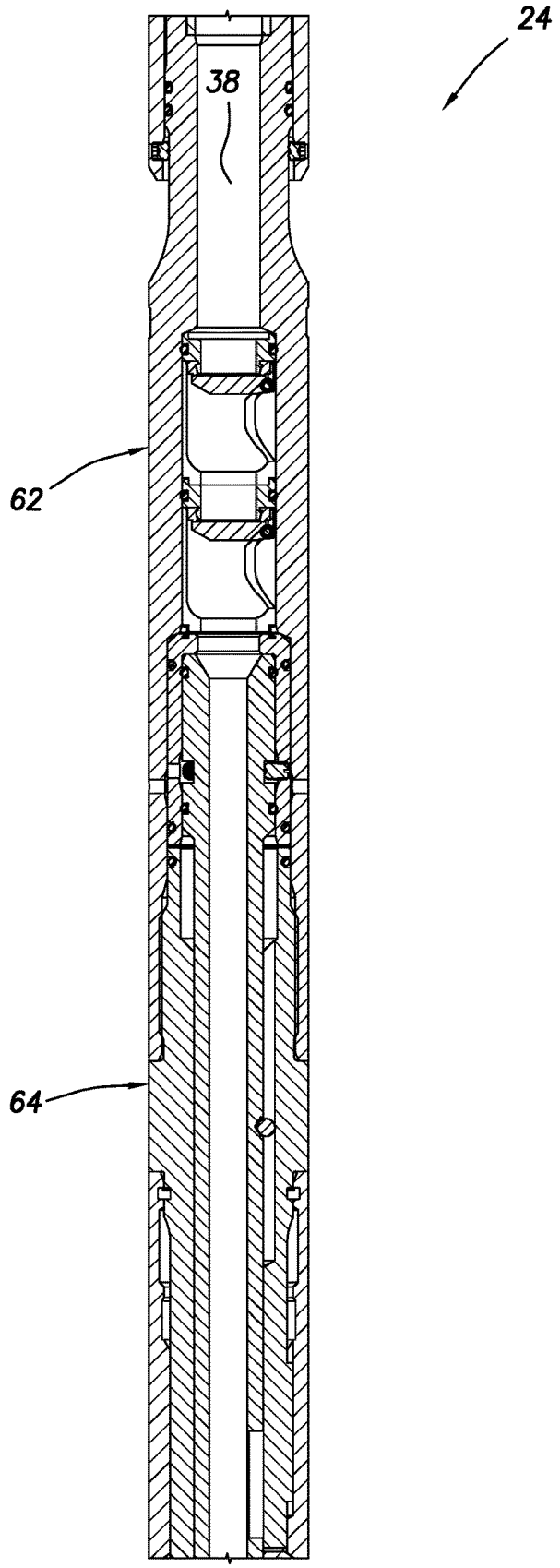
Figure 2C:
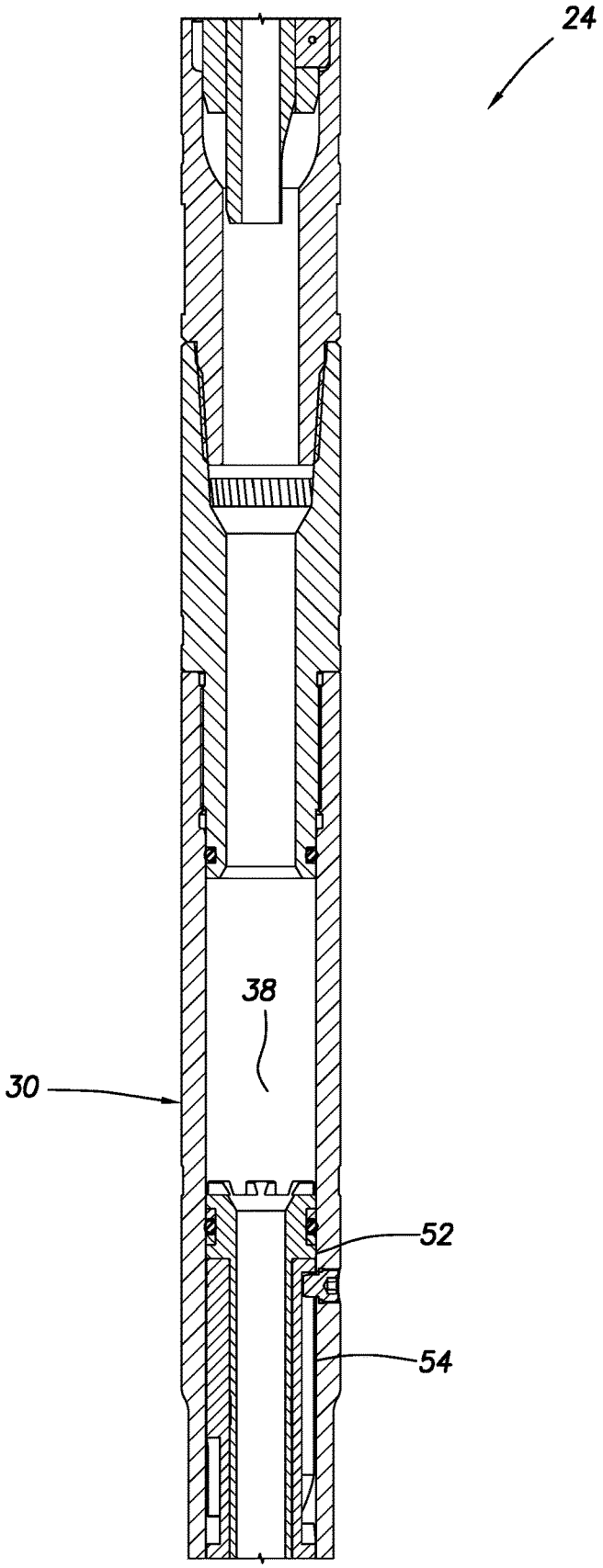
Figure 2D:
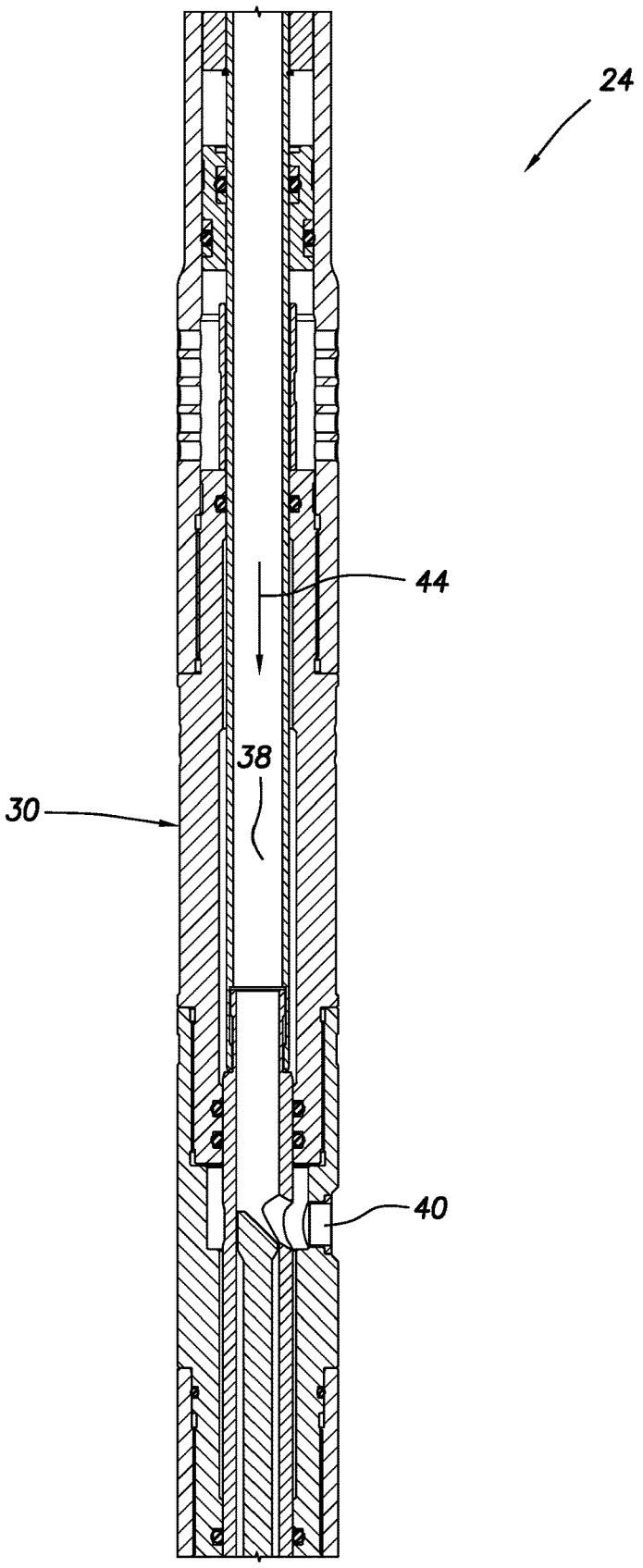
Figure 2E:
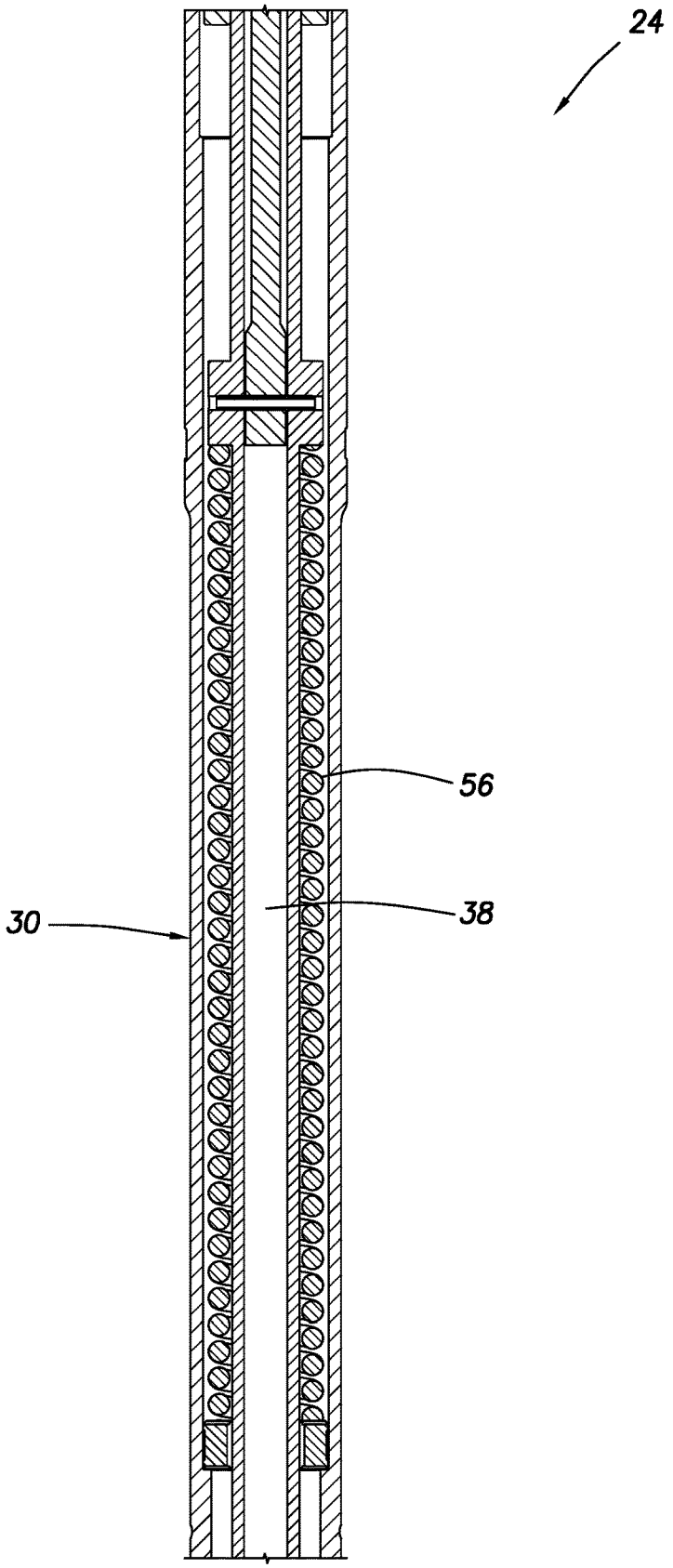
Figure 2F:
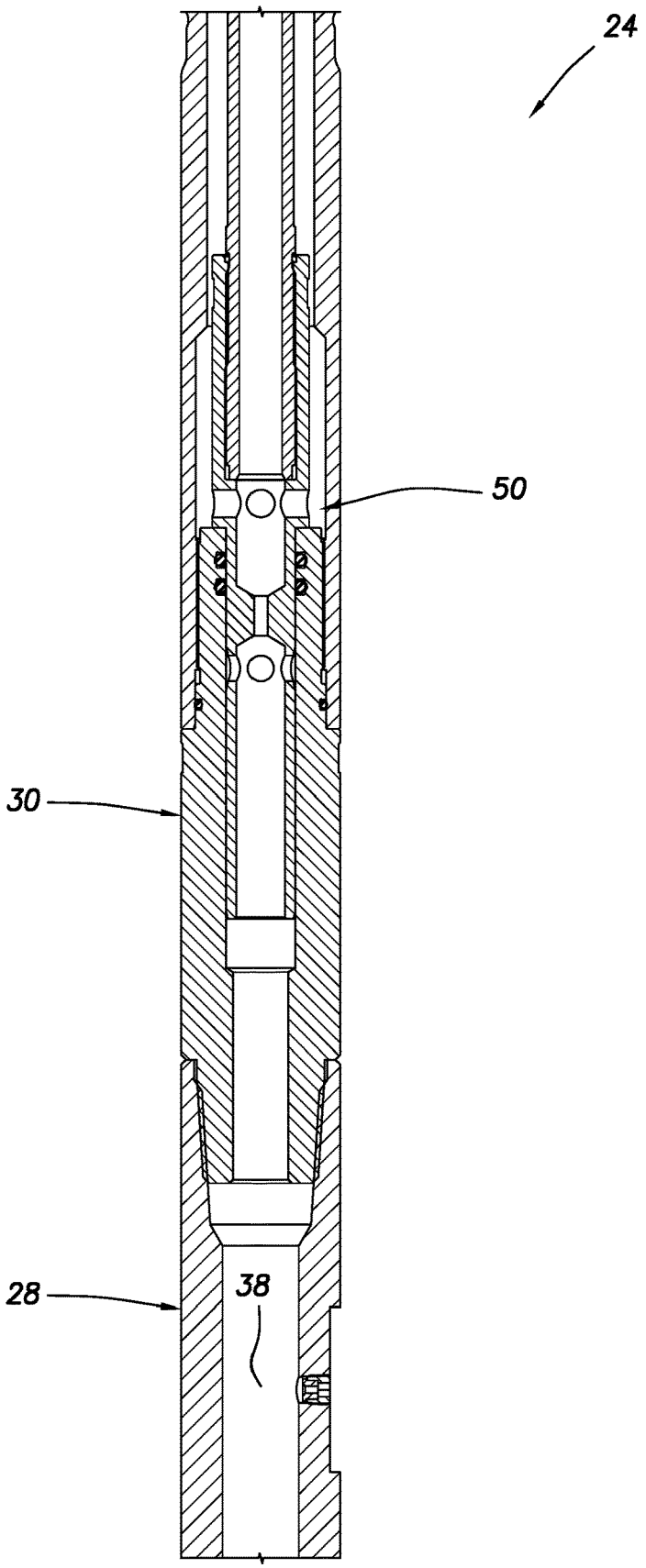
Figure 2G:
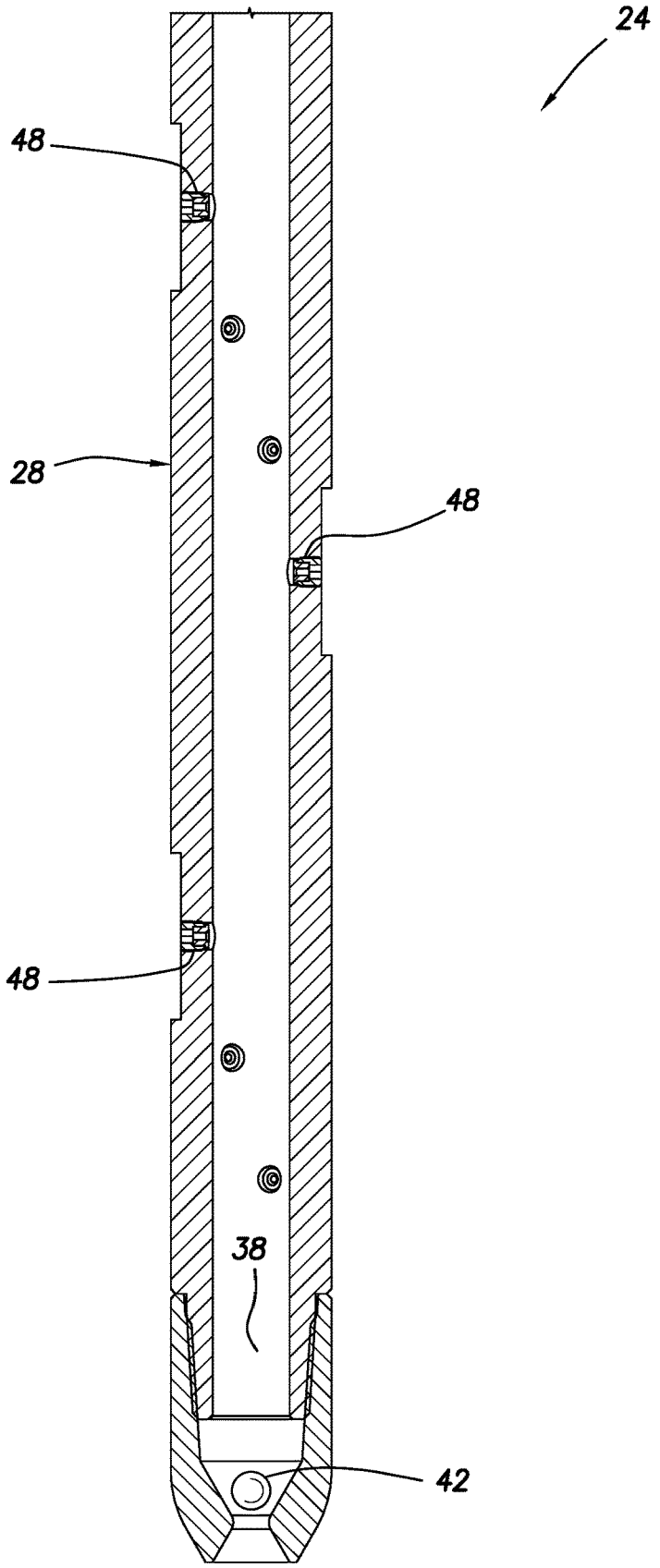

Another example restriction 36 is representatively illustrated in FIG. 1D. In this example, the restriction 36 comprises an expandable tube or ball seat that the plugging device 42 can be pumped though at the predetermined pressure differential.

Instead of extruding or otherwise deforming the plugging device 42, the expandable restriction 36 enlarges sufficiently at the predetermined pressure differential to allow the plugging device 42 to pass through the restriction. The restriction 36 may, for example, be made of an elastomeric material or another deformable material or structure that can be sealingly engaged by the plugging device 42 and enlarged in response to application of the predetermined differential pressure across the plugging device.

Another example of the well tool assembly 24 is representatively illustrated in FIGS. 2A-G. In this example, the well tool assembly 24 includes a valve assembly 30. This discharge port 40 is opened and closed by operation of the valve assembly 30.

The valve assembly 30 may be the same as or similar to that described in U.S. Pat. No. 9,494,014, the entire disclosure of which is incorporated herein by this reference for all purposes. The valve assembly 30 is operated by manipulation of the flow rate of the fluid 44 through the flow passage 38 to displace a piston 52 down (as viewed in FIGS. 2C-D) and thereby open the discharge port 40.

A J-slot mechanism 54 is used to hold the port 40 open. The port 40 is closed by applying a subsequent increased flow rate that shifts the J-slot mechanism 54 to a different position that permits the port 40 to be closed by a biasing force exerted by a spring 56.

Thus, the discharge port 40 is alternately opened and closed in response to a series of flow rate manipulations. The specific pattern of flow rate manipulations is determined by a cam profile of the J-slot mechanism 54. In this example, the discharge port 40 is alternately open and closed when the flow rate is decreased following a flow rate increase to at least a predetermined level. The discharge port 40 is open when the flow rate is at or greater than the predetermined level.

Selectively fired tubing conveyed explosive type perforators may be used in place of the abrasive jet perforator 28, although there may be practical limitations on the maximum number of stages possible.

The perforation plugs discharged from the flow passage 38 via the discharge port 40 may be any type of ball sealers, "frac" balls, diverters, plugging devices or substances capable of blocking flow from the wellbore (e.g., the interior of the casing 16) into a perforated formation zone. Examples of suitable plugging devices are described in US Publication No. 2017/0292343, the entire disclosure of which is incorporated herein by this reference for all purposes. However, the scope of this disclosure is not limited to use of any particular type of perforation plugs.

A perforation plug could seal off a perforation by sealingly engaging a body of the perforation plug with the perforation, thereby physically blocking flow through the perforation itself. In other examples, the perforation plug could comprise a particulate matter or other substance that enters the perforation and blocks fluid flow from the perforation into the formation zone (e.g., the substance could form a flow blocking layer or coating on the formation zone in the perforation, or the substance could enter the formation zone and thereby substantially decrease its permeability). The scope of this disclosure is not limited to any particular mechanism or technique by which the perforation plugs block flow from the wellbore to the formation zone via the perforations.

The perforation plug could be degradable in the well due to any of a variety of different stimulants (e.g., passage of time, elevated temperature, exposure to well fluid, exposure to a particular degrading fluid or substance, exposure to radiation, etc.). If the perforation plug is degradable, it may be self-degrading or degradable in response to a particular action taken (such as, spotting an acid in the wellbore proximate the perforation plug).

One significant feature of the example method described above is that between-stage nonproductive time is substantially eliminated. Another significant feature is the capability to recover from a sand off condition by pumping though the perforator 28. The elimination of the pad will greatly reduce the time and amount of fluid required to fracture the well.

Figure 3:
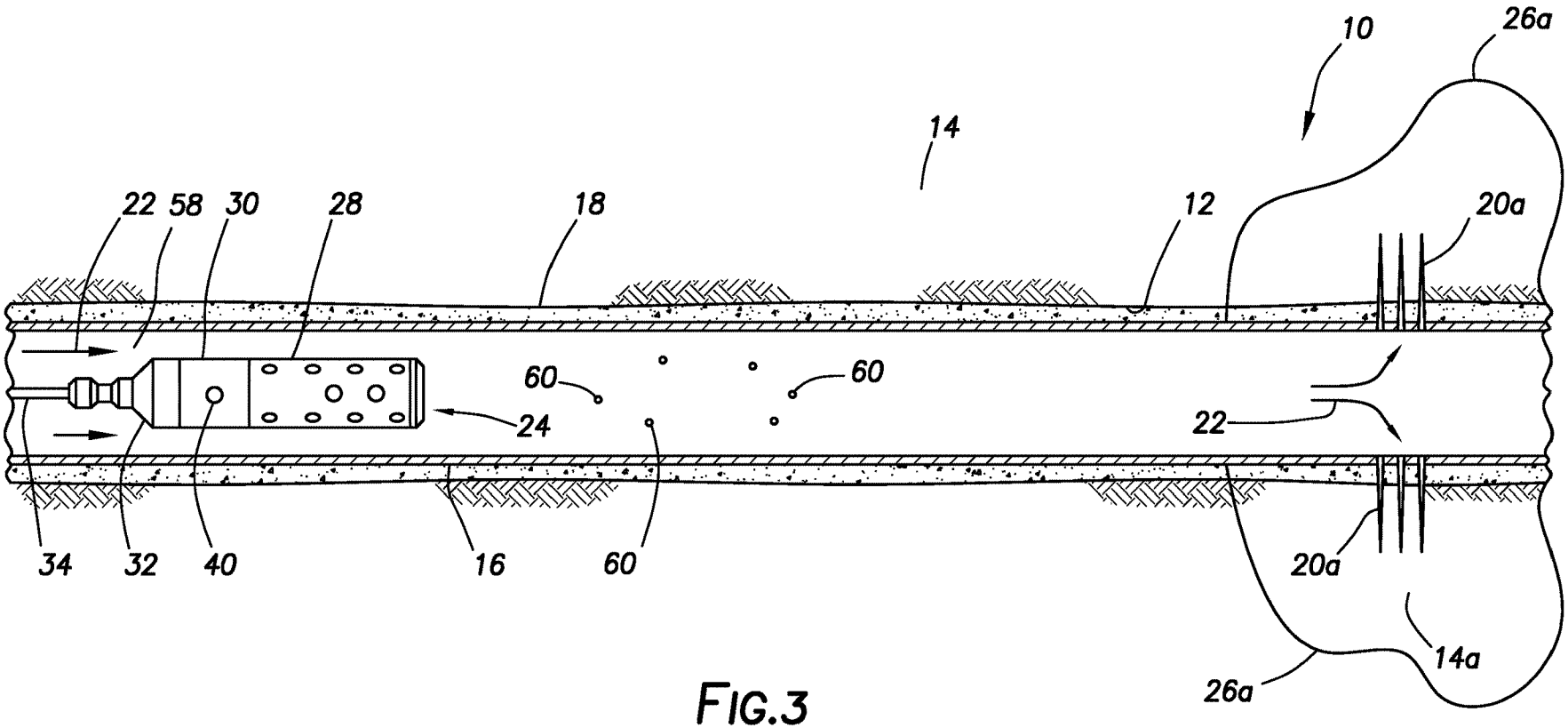
FIGS. 3-5 are representative partially cross-sectional views of a succession of steps in an example of a method of perforating and treating multiple formation zones.
Figure 4:
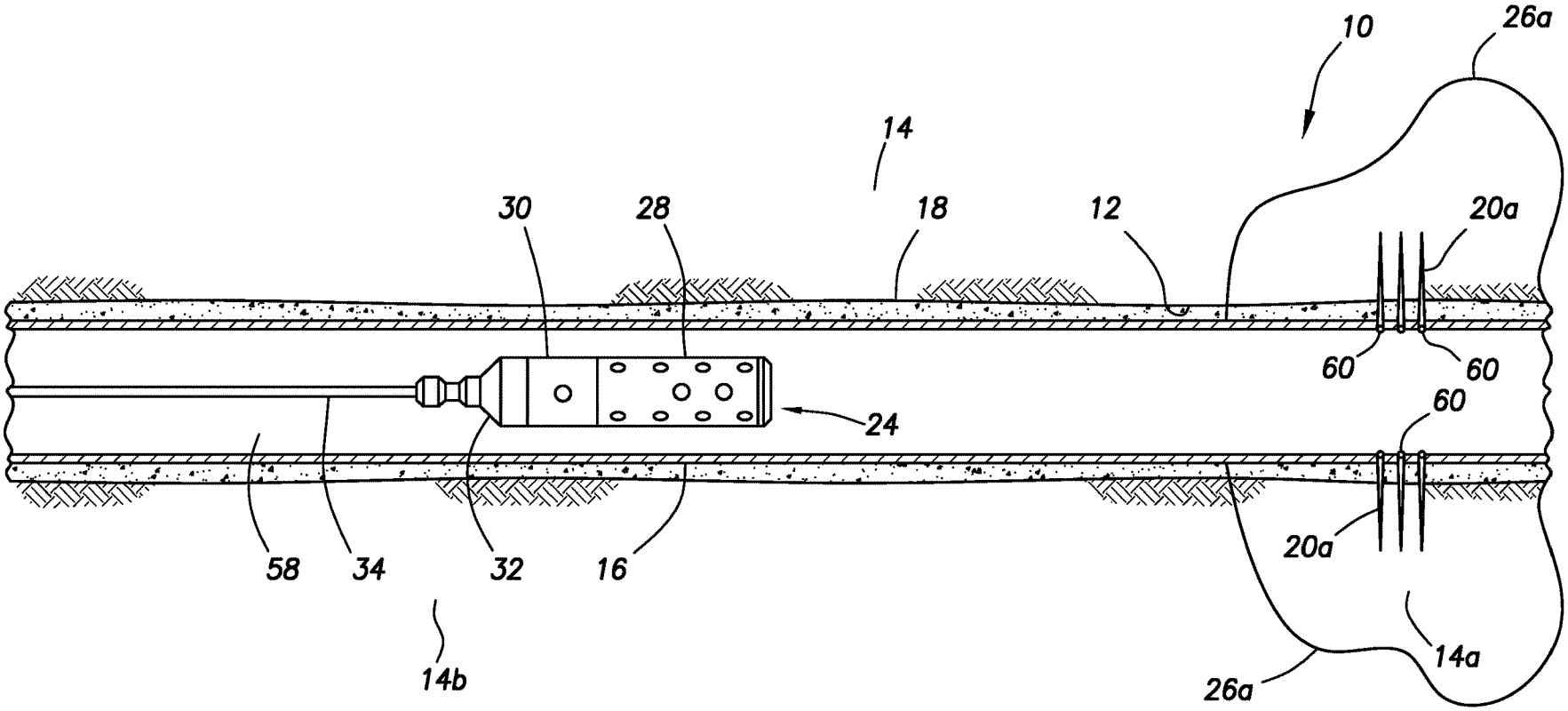
Figure 5:
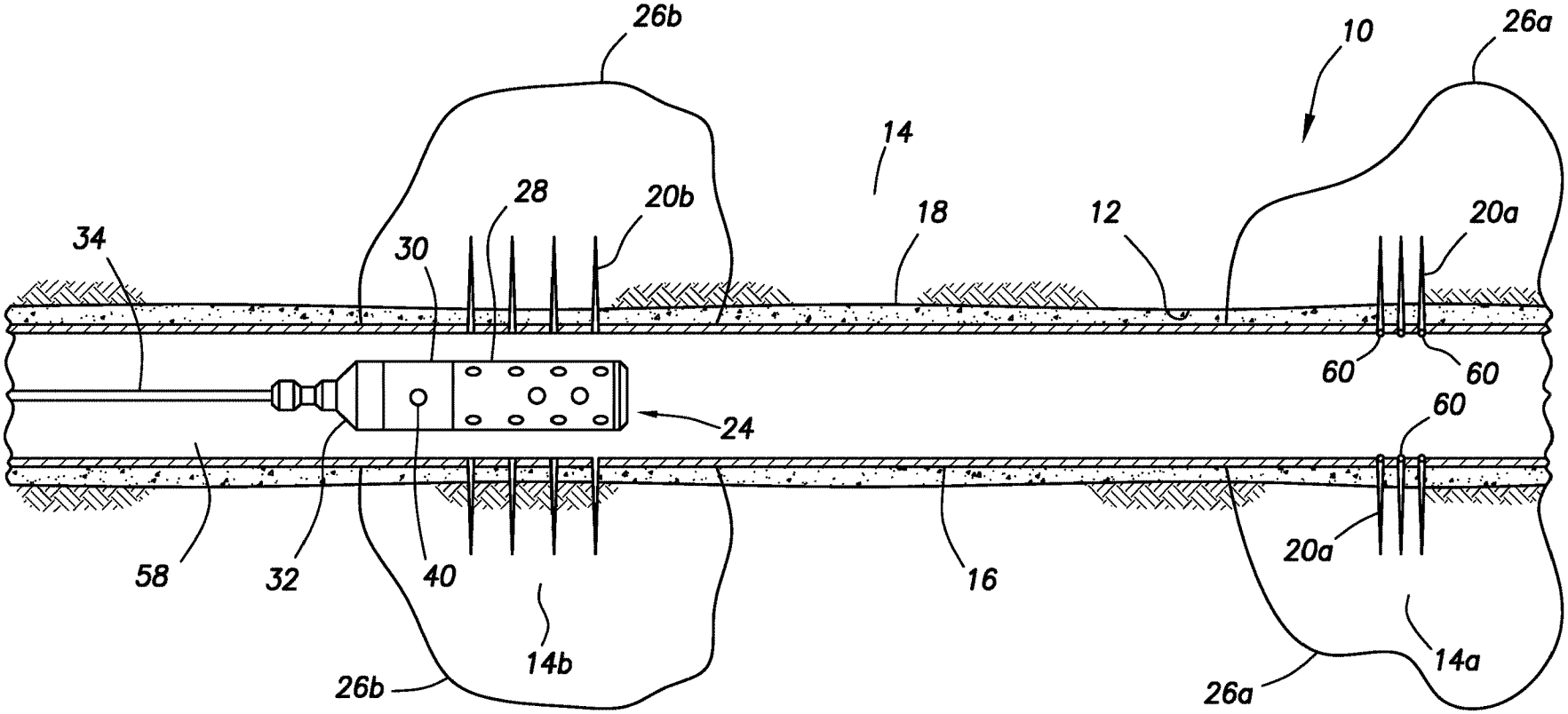

One example method (see FIGS. 3-5) for use with a multi-zone well treatment system 10 includes the steps of:

1. Perforating a first formation zone 14*a* using a perforator 28 to form perforations 20*a* extending through casing 16 and cement 18 lining a wellbore 12. A ball, dart or other plugging device 42 can close off a lower end of an abrasive perforator 28 by engaging a restriction 36 or expandable seat as depicted in FIGS. 1C & 1D. In this example, the abrasive perforator 28 forms the perforations 20*a* by directing a fluid jet comprising abrasive particles toward the casing 16.

2. Treating the first zone 14*a*. In this example, the treating includes forming fractures 26*a* in the zone 14*a* by pumping fluid 22 (which may comprise a slurry including proppant, water, acid, gel and/or other treatment substances) from the surface through an annulus 58 formed between the casing 16 and the tubular string 34 (such as a segmented or continuous tubing string). The tubular string 34 is connected to the well tool assembly 24, which in this example includes the perforator 28 and the valve assembly 30 (see FIGS. 2A-G).

3. Discharging the perforation plugs 60 from the tubular string 34. In this example, the perforation plugs 60 are pumped downhole via the tubular string 34, and are discharged from the valve assembly 30. The valve assembly 30 can be operated as described above (e.g., by manipulating a flow rate through the valve assembly) to open its discharge port 40. If, however, the FIGS. 1A-C well tool assembly is used, the ball or other plugging device 42 can be discharged from the lower end of the perforator 28, and the perforation plugs 60 can be pumped through the discharge port 40 into the casing 16. The perforation plugs 60 can be discharged from the well tool assembly 24 while the treatment fluid 22 is being flowed, for example, at or near a conclusion of step 2 above. The perforation plugs 60 block flow through the perforations 20*a* into the formation zone 14*a* (see FIG. 4).

4. Displacing the well tool assembly 24 to another location in the wellbore 12, so that the perforator 28 is aligned with a next formation zone 14*b* (see FIG. 5). The well tool assembly 24 may be displaced during or after the perforation plugs 60 are discharged from the discharge port 40. The well tool assembly 24 may be displaced during or after the treatment fluid 22 is being flowed into the zone 14*a*.

5. Perforating the second formation zone 14*b* using the perforator 28 to form perforations 20*b* extending through the casing 16 and cement 18, and into the zone. A ball, dart or other plugging device 42 can close off a lower end of the abrasive perforator 28 by engaging a restriction 36 or expandable seat as depicted in FIG. 1C or 1D. The plugging device 42 may be installed or dropped during or after either of steps 4 & 5.

Step 2 can be repeated for the second zone 14*b* (for example, to form fractures 26*b* in the second zone), and step 3 can be repeated if one or more additional zones are to be perforated and treated. Steps 1-4 can be performed for each zone or stage to be perforated and treated, except that steps 3 and 4 would not be performed for the last zone or stage.

In the well treatment system 10 and associated method, the perforation plugs 60 are discharged from a well tool assembly 24 comprising a perforator 28. The well tool assembly 24 may also comprise a valve assembly 30 for discharging the perforation plugs 60 from the well tool assembly. The well tool assembly 24 may operate to selectively open and close the discharge port 40 in response to manipulations of the flow rate (and corresponding pressure differentials between the flow passage 38 and the annulus 58 or exterior of the valve assembly) of the fluid 44 through the flow passage.

The well tool assembly 24 may comprise a restriction 36 (e.g., an expandable plug seat as depicted in FIG. 1D) for releasably retaining a plugging device 42 that blocks flow through the flow passage 38 downstream of the perforator 28. The plugging device 42 may be installed in the well tool assembly 24 prior to perforating a formation zone 14*a* or 14*b*. The plugging device 42 may be discharged from the well tool assembly 24 prior to discharging the perforation plugs 60 from the well tool assembly 24.

Figure 6:
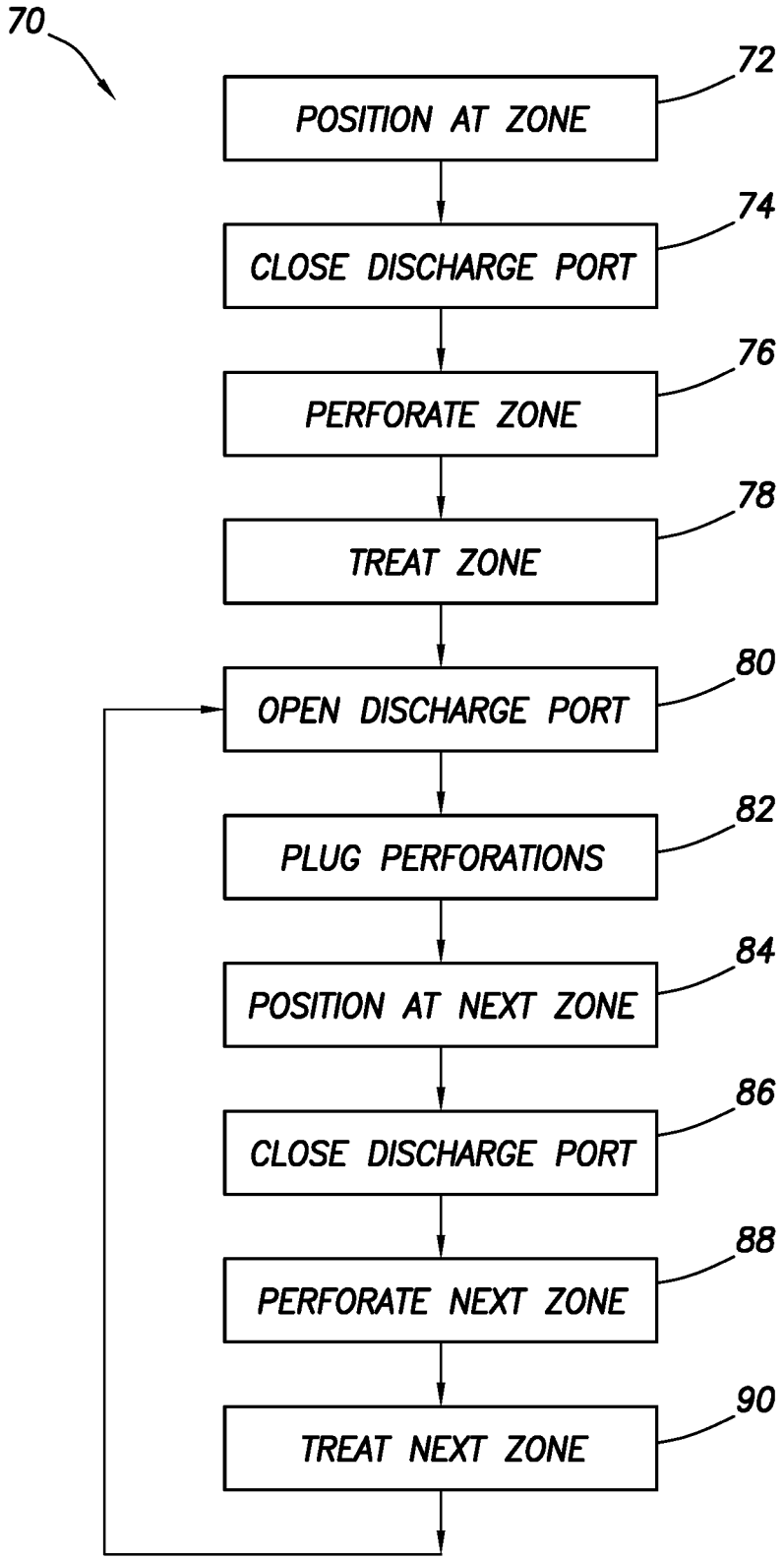
FIG. 6 is a representative flowchart for another example of a method of perforating and treating multiple formation zones.

Referring additionally now to FIG. 6 a representative flowchart for another example of the method 70 for perforating and treating multiple formation zones in a well is depicted. The FIG. 6 method 70 may be practiced using the system 10 and well tool assembly 24 examples described above, or another system or well tool assembly may be used with the method. In the further description below, the system 10 and well tool assembly 24 is used in the method 70.

In step 72, the well tool assembly 24 is run into the wellbore 12 and is positioned so that the perforator 28 is aligned with the zone 14*a*. In this example, the well tool assembly 24 is conveyed on the tubular string 34, which may comprise a continuous tubing string (e.g., coiled tubing) or a segmented tubing string.

In step 74, the discharge port 40 is closed. The plugging device 42 may be deployed into the well tool assembly 24, so that it sealingly engages the restriction 36 and thereby prevents flow through the flow passage 38 downstream of the perforator 28. If the FIG. 2A-G well tool assembly 24 is used, a flow rate of the fluid 44 through the flow passage 38 may be manipulated, so that the discharge port 40 is closed (if the discharge port is not already closed). In either case, the discharge port 40 may be closed prior to or after the well tool assembly 24 is run into the well or positioned as described above for step 72.

In step 76, the zone 14*a* is perforated by the perforator 28. In this example, the fluid 44 comprising abrasive particles is flowed through the flow passage 38 and out of the nozzles 48, so that it impinges on the casing 16 and eventually forms the perforations 20*a* through the casing and cement 18, and into the zone 14*a*. In other examples, an explosive, mechanical, chemical or other type of perforator may be used in the well tool assembly 24 to form the perforations 20*a*.

In step 78, the zone 14*a* is treated by flowing the treatment fluid 22 from the surface and through the annulus 58 to the open perforations 20*a*. The treatment fluid 22 flows through the perforations 20*a* and into the zone 14*a*, for example, to form the fractures 26*a*. It is not necessary, however, for fractures to be formed in the zone 14*a* during this treatment step.

In step 80, the discharge port 40 is opened. In the FIGS. 1A-C example of the well tool assembly 24, the discharge port 40 can be opened by increasing the pressure differential from the flow passage 38 to the exterior of the well tool assembly (e.g., across the plugging device 42), thereby deforming the plugging device so that it passes through (e.g., is extruded through) the restriction 36.

In the FIG. 1D example, the discharge port 40 can be opened by increasing the pressure differential from the flow passage 38 to the exterior of the well tool assembly (e.g., across the plugging device 42), thereby deforming the restriction 36 (e.g., expanding or otherwise enlarging the restriction) so that the plugging device can pass through the restriction.

In the FIGS. 2A-G example, the discharge port 40 can be opened by manipulating the flow rate of the fluid 44 through the passage 38 to thereby manipulate the pressure differential from the passage to the exterior of the well tool assembly 24.

Note that the discharge port 40 can be opened in the step 80 prior to or after conclusion of the treatment step 78. In this manner, discharge of the perforation plugs 60 from the well tool assembly 24 can begin prior to or after conclusion of the treatment step 78, so that unproductive time between these steps is eliminated, or at least minimized or substantially reduced.

In step 82, the perforations 20*a* are plugged by discharging the perforation plugs 60 from the well tool assembly 24 via the open discharge port 40. As mentioned above, the perforation plugs 60 may begin to be discharged prior to conclusion of the treatment step 78, for example, to divert the fluid 22 from perforations 20*a* taking most of the fluid to perforations taking less fluid. Preferably, at a conclusion of the perforation plugging step 82, all of the perforations 20*a* are plugged, so that they will take no further (or minimal) fluid during subsequent treatments of additional zones.

In step 84, the well tool assembly 24 is repositioned, so that the perforator 28 is aligned with the next zone 14*b* to be treated. The well tool assembly 24 may be repositioned before, during or after the treatment step 78, discharge port opening step 80 or perforation plugging step 82. Thus, the well tool assembly 24 may be repositioned at any time after the zone 14*a* perforating step 76, and before the zone 14*b* perforating step 88 described below.

In step 86, the discharge port 40 is closed. Closing of the discharge port 40 permits the perforator 28 to be used to form the perforations 20*b* into the zone 14*b*. In the FIGS. 1A-D examples, the discharge port 40 may be closed by deploying another plugging device 42 into the flow passage 38, so that it will sealingly engage the restriction 36.

In the FIGS. 2A-G example, the discharge port 40 may be closed by manipulating the flow rate of the fluid 44 through the flow passage 38, thereby manipulating the pressure differential from the flow passage to the exterior of the well tool assembly 24. Note that, when the discharge port 40 is closed, a valve 50 (see FIG. 2F) that selectively permits and prevents flow through the passage 38 is opened, thereby permitting flow of the fluid 44 to the perforator 28. The valve 50 is closed when the discharge port 40 is open, in this example.

In step 88, the zone 14*b* is perforated by the perforator 28. In this example, the fluid 44 comprising abrasive particles is flowed through the flow passage 38 and out of the nozzles 48, so that it impinges on the casing 16 and eventually forms the perforations 20*b* through the casing and cement 18, and into the zone 14*b*. In other examples, an explosive, mechanical, chemical or other type of perforator may be used in the well tool assembly 24 to form the perforations 20*b*.

In step 90, the zone 14*b* is treated by flowing the treatment fluid 22 from the surface and through the annulus 58 to the open perforations 20*b*. The treatment fluid 22 flows through the perforations 20*b* and into the zone 14*b*, for example, to form the fractures 26*b*. It is not necessary, however, for fractures to be formed in the zone 14*b* during this treatment step.

If additional zones are to be perforated and treated, steps 80-90 may be repeated for each additional zone. It will be appreciated that any number of zones may be perforated and treated using the method 70, with only a single trip of the well tool assembly 24 into the well.

Referring again to the well tool assembly 24 example of FIGS. 1A-D, it may be seen that this example includes a tubing connector 32, back pressure valves 62 and a hydraulic release tool 64 connected between the tubular string 34 and the perforator 28. A suitable tubing connector for use as the tubing connector 32 in the well tool assembly 24 is the External Slip Type Coiled Tubing Connector marketed by Thru Tubing Solutions, Inc. of Oklahoma City, Okla. USA. A suitable back pressure valve assembly for use as the back pressure valves 62 is the Dual Flapper Back Pressure Valve marketed by Thru Tubing Solutions, Inc. A suitable hydraulic release tool for use as the hydraulic release tool 64 is the Hydraulic Disconnect marketed by Thru Tubing Solutions, Inc. Additional, fewer or different well tools may be used in the FIGS. 1A-D well tool assembly 24, in keeping with the principles of this disclosure.

Referring additionally to the well tool assembly 24 example of FIGS. 2A-G, it may be seen that this example includes the tubing connector 32, the back pressure valves 62, the hydraulic release tool 64 and the valve assembly 30 connected between the tubular string 34 and the perforator 28. A suitable valve assembly for use as the valve assembly 30 in the well tool assembly 24 is that described in U.S. Pat. No. 9,494,014. Additional, fewer or different well tools may be used in the FIGS. 2A-G well tool assembly 24, in keeping with the principles of this disclosure.

A downhole well tool assembly 24 described herein can comprise a perforator 28 and a selectively openable and closable perforation plug discharge port 40.

In any of the examples described herein, the downhole well tool assembly 24 can comprise a valve assembly 30 configured to selectively open and close the perforation plug discharge port 40 in response to manipulation of a fluid flow rate through a longitudinal flow passage 38 extending through the valve assembly 30.

In any of the examples described herein, the flow passage 38 may extend longitudinally through the perforator 28.

In any of the examples described herein, the valve assembly 24 can comprise a valve 50 that opens and permits fluid flow through the flow passage 38 to the perforator 28 when the perforation plug discharge port 40 is closed.

In any of the examples described herein, the valve 50 may close and prevent fluid flow through the flow passage 38 to the perforator 28 when the perforation plug discharge port 40 is open.

In any of the examples described herein, sealing engagement between a plugging device 42 and a restriction 36 in a flow passage 38 extending longitudinally through the perforator 28 may block flow through the perforation plug discharge port 40.

In any of the examples described herein, the plugging device 42 may be configured to deform and pass through the restriction 36 in response to a predetermined pressure differential applied from the flow passage 38 to an exterior of the downhole well tool assembly 24.

In any of the examples described herein, the restriction 36 may be configured to enlarge and permit the plugging device 42 to pass through the restriction 36 in response to a predetermined pressure differential applied from the flow passage 38 to an exterior of the downhole well tool assembly 24.

In any of the examples described herein, the perforation plug discharge port 40 may be positioned downstream of the perforator 28 relative to fluid flow through the flow passage 38.

In any of the examples described herein, fluid flow may be permitted through the perforation plug discharge port 40 and nozzles 48 of the perforator 28 simultaneously when the plugging device 42 is not sealingly engaged with the restriction 36.

A method 70 of perforating and treating multiple formation zones 14*a,b* of a well in a single trip of a downhole well tool assembly 24 into the well is described herein. In one example, the method 70 can comprise:

(a) positioning the downhole well tool assembly 24 at a first zone 14*a;*

(b) closing a perforation plug discharge port 40 of the downhole well tool assembly 24;

(c) perforating the first zone 14*a;*

(d) treating the first zone 14*a;*

(e) opening the perforation plug discharge port 40;

(f) deploying perforation plugs 60 into the well via the perforation plug discharge port 40;

(g) plugging perforations 20*a* in the first zone 14*a* with the perforation plugs 60;

(h) positioning the downhole well tool assembly 24 at a second zone 14*b;*

(i) closing the perforation plug discharge port 40;

(j) perforating the second zone 14*b*; and (k) treating the second zone 14*b*.

In any of the examples described herein, the step of closing the perforation plug discharge port 40 may be performed prior to the step of positioning the downhole well tool assembly 24 at the first zone 14*a*.

In any of the examples described herein, the step of closing the perforation plug discharge port 40 may be performed after the step of positioning the downhole well tool assembly 24 at the first zone 14*a*.

In any of the examples described herein, the step of closing the perforation plug discharge port 40 may be performed during the step of positioning the downhole well tool assembly 24 at the first zone 14*a*.

In any of the examples described herein, the step of opening the perforation plug discharge port 40 may be performed prior to the step of treating the first zone 14*a*.

In any of the examples described herein, the step of opening the perforation plug discharge port 40 may be performed after the step of treating the first zone 14*a*.

In any of the examples described herein, the step of opening the perforation plug discharge port 40 may be performed during the step of treating the first zone 14*a*.

In any of the examples described herein, the step of opening the perforation plug discharge port 40 may comprise increasing a pressure differential from an interior to an exterior of the downhole well tool assembly 24.

In any of the examples described herein, the step of increasing the pressure differential may comprise deforming a plugging device 42 through a restriction 36 in a flow passage 38 extending longitudinally through a perforator 28.

In any of the examples described herein, increasing the pressure differential may comprise deforming a restriction 36 in a flow passage 38 extending longitudinally through a perforator 28, thereby permitting a plugging device 42 to pass through the restriction 36.

In any of the examples described herein, increasing the pressure differential may comprise increasing a flow rate through a flow passage 38 extending longitudinally through the downhole well tool assembly 24.

In any of the examples described herein, the flow passage 38 may extend longitudinally through a perforator 28 of the downhole well tool assembly 24.

In any of the examples described herein, increasing the pressure differential may further comprise closing a valve 50 of the downhole well tool assembly 24, thereby preventing fluid flow to a perforator 28 of the downhole well tool assembly 24.

In any of the examples described herein, the method may further comprise, after step (k):

(l) opening the perforation plug discharge port 40;

(m) deploying perforation plugs 60 into the well via the perforation plug discharge port 40;

(n) plugging perforations 20*b* in the second zone 14*b* with the perforation plugs 60;

(o) positioning the downhole well tool assembly 24 at a third zone;

(p) closing the perforation plug discharge port 40;

(q) perforating the third zone; and (r) treating the third zone.

Another method of perforating and treating multiple formation zones 14*a,b* of a well in a single trip of a downhole well tool assembly 24 into the well is described herein. In one example, the method can comprise:

(a) perforating a first zone 14*a* with an abrasive perforator 28 of a downhole well tool assembly 24;

(b) treating the first zone 14*a* by flowing a treatment fluid 22 through an annulus 58 formed between the downhole well tool assembly 24 and a casing 16 of the well;

(c) discharging perforation plugs 60 from the downhole well tool assembly 24, thereby plugging perforations 20*a* of the first zone 14*a;*

(d) positioning the downhole well tool assembly 24 at a second zone 14*b;*

(e) perforating the second zone 14*b* with the abrasive perforator 28; and (f) treating the second zone 14*b* by flowing the treatment fluid 22 through the annulus 58.

In any of the examples described herein, step (c) may be commenced prior to conclusion of step (b).

In any of the examples described herein, step (d) may be commenced prior to conclusion of step (b).

In any of the examples described herein, step (d) may be commenced prior to conclusion of step (c).

In any of the examples described herein, the step of discharging the perforation plugs 60 may comprise displacing the perforation plugs 60 through the abrasive perforator 28.

In any of the examples described herein, the step of discharging the perforation plugs 60 may comprise displacing the perforation plugs 60 through a flow passage 38 extending longitudinally through the abrasive perforator 28.

In any of the examples described herein, the step of discharging the perforation plugs 60 may comprise displacing a plugging device 42 through a restriction 36 in a flow passage 38 extending longitudinally through the downhole well tool assembly 24.

In any of the examples described herein, the step of displacing the plugging device 42 through the restriction 36 may comprise deforming the plugging device 42.

In any of the examples described herein, the step of displacing the plugging device 42 through the restriction 36 may comprise deforming the restriction 36.

In any of the examples described herein, the step of discharging the perforation plugs 60 may comprise manipulating a fluid flow rate through the downhole well tool assembly 24, thereby opening a perforation plug discharge port 40 of the downhole well tool assembly 24.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of perforating and treating multiple formation zones of a well in a single trip of a downhole well tool assembly into the well, the method comprising:

(a) positioning the downhole well tool assembly at a first zone;

(b) closing a perforation plug discharge port of the downhole well tool assembly, in which a first manipulation of a flow rate of a fluid flowing through a flow passage extending longitudinally through the downhole well tool assembly causes the perforation plug discharge port to close;

(c) perforating the first zone;

(d) treating the first zone;

(e) opening the perforation plug discharge port, in which a second manipulation of the flow rate of the fluid flowing through the flow passage causes the perforation plug discharge port to open, and in which the first and second manipulations each comprise decreasing the flow rate of the fluid after the flow rate has been increased to at least a predetermined level;

(f) deploying perforation plugs into the well via the perforation plug discharge port;

(g) plugging perforations in the first zone with the perforation plugs;

(h) positioning the downhole well tool assembly at a second zone;

(i) closing the perforation plug discharge port;

(j) perforating the second zone; and (k) treating the second zone.

2. The method of claim 1, in which the step of closing the perforation plug discharge port is performed prior to the step of positioning the downhole well tool assembly at the first zone.

3. The method of claim 1, in which the step of closing the perforation plug discharge port is performed after the step of positioning the downhole well tool assembly at the first zone.

4. The method of claim 1, in which the step of closing the perforation plug discharge port is performed during the step of positioning the downhole well tool assembly at the first zone.

5. The method of claim 1, in which the step of opening the perforation plug discharge port is performed prior to the step of treating the first zone.

6. The method of claim 1, in which the step of opening the perforation plug discharge port is performed after the step of treating the first zone.

7. The method of claim 1, in which the step of opening the perforation plug discharge port is performed during the step of treating the first zone.

8. The method of claim 1, in which the flow passage extends longitudinally through a perforator of the downhole well tool assembly.

9. The method of claim 1, further comprising closing a valve of the downhole well tool assembly, thereby preventing fluid flow to a perforator of the downhole well tool assembly.

10. The method of claim 1, further comprising, after step (k):

(l) opening the perforation plug discharge port;

(m) deploying perforation plugs into the well via the perforation plug discharge port;

(n) plugging perforations in the second zone with the perforation plugs;

(o) positioning the downhole well tool assembly at a third zone;

(p) closing the perforation plug discharge port;

(q) perforating the third zone; and (r) treating the third zone.

* * * * *